US011830682B1

(12) United States Patent
Worsham

(10) Patent No.: US 11,830,682 B1
(45) **Date of Patent: *Nov. 28, 2023**

(54) DISPLAY COVER APPARATUS FOR A PUSH BUTTON SWITCH

(71) Applicant: David Worsham, Santa Rosa Beach, FL (US)

(72) Inventor: David Worsham, Santa Rosa Beach, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/189,335

(22) Filed: Mar. 2, 2021

Related U.S. Application Data

(63) Continuation of application No. 16/583,331, filed on Sep. 26, 2019, now Pat. No. 10,998,148.

(51) Int. Cl.
*H01H 13/04* (2006.01)

(52) U.S. Cl.
CPC ..... *H01H 13/04* (2013.01); *H01H 2219/006* (2013.01)

(58) Field of Classification Search
CPC .... H01H 13/04; H01H 2219/006; H01H 3/12; H01H 3/122; H01H 3/125; H01H 9/16; H01H 2219/00
USPC ..... 200/341, 308–314
See application file for complete search history.

(56) References Cited

U.S. PATENT DOCUMENTS

| | | | | |
|---|---|---|---|---|
| 8,130,214 | B2 * | 3/2012 | Aimi | G06F 3/0362 345/184 |
| 9,543,089 | B2 * | 1/2017 | Kirita | H01H 13/023 |
| 10,998,148 | B1 * | 5/2021 | Worsham | H01H 13/04 |
| 2009/0308723 | A1 * | 12/2009 | Cheng | H01H 13/14 200/345 |
| 2012/0199461 | A1 * | 8/2012 | Shim | B60R 25/00 200/52 R |

* cited by examiner

*Primary Examiner* — Renee S Luebke
*Assistant Examiner* — Iman Malakooti
(74) *Attorney, Agent, or Firm* — Lanier Ford Shaver & Payne, P.C.; Gerald M. Walsh

(57) ABSTRACT

A display cover apparatus having a display cover for a push button on a push button switch, a holder for the display cover, and a housing. The display cover has lock hooks and the holder has a hollow interior, a top end with lock slots that removably connect to the lock hooks, a bottom end, a flexible retaining washer in a groove at the bottom end, and a locking key between the top end and the bottom end. The holder is positioned on a circular shelf in an interior of the housing. The circular shelf has an internal circular flange with a locking slot that receives the locking key to prevent rotation of the holder in the housing. The flexible retaining washer is positioned beneath the flange. The circular shelf and the flexible retaining washer prevent linear movement of the holder in the housing. An alignment hook on the display cover removably connects to an alignment slot on the holder, thereby preventing the display cover from rotating on the holder.

15 Claims, 8 Drawing Sheets

DISPLAY COVER APPARATUS FOR A PUSH BUTTON SWITCH

CROSS-REFERENCE TO RELATED APPLICATION

This application is a continuation of application Ser. No. 16/583,331, filed Sep. 26, 2019, the entirety of which is incorporated by reference herein.

FIELD OF THE INVENTION

This invention relates to push button switches and, more particularly, to a display cover apparatus for the attachment of removable display covers on a push button of a push button switch, thereby providing a variety of changeable displays for the push button.

BACKGROUND OF THE INVENTION

Some push button switches, for example multipin or antivandal push button switches, have push buttons of sufficient size to display information such as a logo or a symbol. FIG. 1 shows a typical antivandal pushbutton switch 6 with a logo design 7 on the face of the push button 8 near the front end 9 of the push button switch 6. However, the logo or design is fixed on the face of the push button and there is no easy or practical way to alter the design or replace the design. It is desirable to have a push button switch configured to hold a cover with a display over the push button so that the cover can be easily removed and replaced with another cover with a different display. Such a push button switch would allow the push button to show an unlimited range of displays selected from an unlimited range of covers each having a different display.

SUMMARY OF THE INVENTION

This invention provides a display cover apparatus and a housing for a push button switch. The display cover apparatus has a display cover for a push button of a push button switch, a holder for the display cover, and a housing for a push button switch. The display cover has a top end, a bottom end, and lock hooks near the top end. The holder has a hollow interior, a top end with lock slots that removably connect to the lock hooks, a bottom end, a flexible retaining washer in a groove at the bottom end, and a locking key between the top end and the bottom end. The housing for the push button switch has a top end, a bottom end, an interior, and a circular shelf in the interior of the housing. The circular shelf is positioned near the top end of the housing and has an internal circular flange with a locking slot that receives the locking key of the holder.

The display cover has an alignment hook that removably connects to an alignment slot on the holder, thereby preventing the display cover from rotating on the holder. The lock hooks connect the display cover removably to the lock slots of the holder to prevent the display cover from falling off the holder. The display cover is flexible, allowing the display cover to operate the push button in and out. When the holder is placed in the housing, the locking key is placed in the locking slot, thereby preventing the holder from rotating inside the housing. The top end of the holder rests on the shelf, thereby preventing the holder from moving toward the bottom end of the housing, and the flexible retaining washer is placed in the groove and under the flange, thereby preventing the holder from moving toward the top end of the housing. The display cover has a groove at the top end of the display cover, the groove allowing removal of the display cover from the holder. When the display cover is placed on the holder, the display cover extends above the housing.

An advantage of the present invention is a display cover for a push button on a push button switch that is replaceable with other display covers, providing an unlimited selection of displays for the push button.

Another advantage is a display cover that does not rotate on the holder and that maintains a fixed orientation of the display over the push button.

Another advantage is a display cover that is flexible so that the push button can be operated by pushing the display cover inward towards the push button.

Another advantage is a holder for the display cover that makes it easy to apply the display cover over the push button and easy to remove it with a finger or thumb.

DETAILED DESCRIPTION OF THE INVENTION

While the following description details the preferred embodiments of the present invention, it is to be understood that the invention is not limited in its application to the details of arrangement of the parts or the illustrations disclosed herein, since the invention is capable of other embodiments and of being practiced in various ways.

Figure 1:
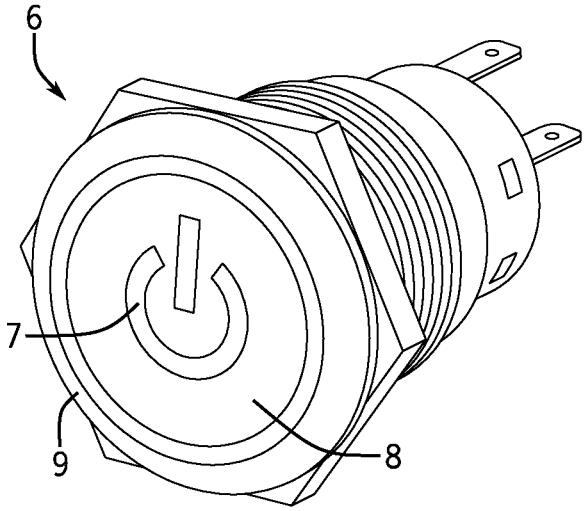
FIG. 1 PRIOR ART
FIG. 1 shows a front perspective view of a push button switch of the prior art having a logo on the face of the push button.
Figure 2:
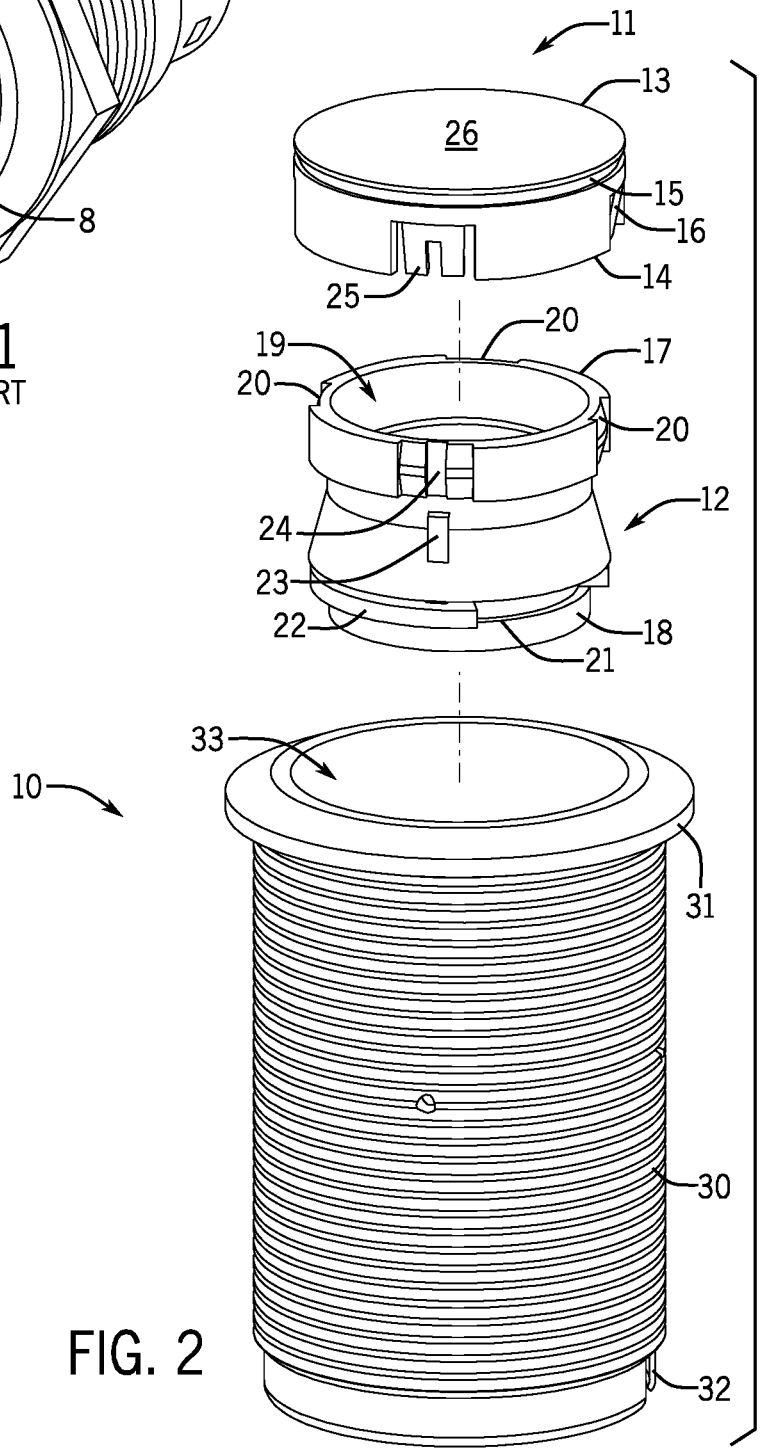
FIG. 2 shows a top perspective view of the display cover apparatus of the present invention having a display cover, a display cover holder, and a push button switch housing.

FIG. 2 shows a top perspective view of the display cover apparatus 10 of the present invention having a display cover 11, a display cover holder 12, and a push button switch housing 30. The display cover 11 is, preferably, circular and has a top end 13 and a bottom end 14. The display cover 11 has a circular groove 15 at the top end 13 and one or more lock hooks 16 on its sides at the bottom end 14. The holder 12 for the display cover 11 is preferably, circular and has a top end 17, a bottom end 18, and an interior 19. The top end 17 has one or more lock slots 20 that connect removably to the lock hooks 16 on the display cover 11. The bottom end 18 has a groove 21 that holds a flexible retaining washer 22. A locking key 23 is positioned between the top end 17 and the bottom end 18. Above the locking key 23 on the top end 17 is an alignment slot 24. The display cover 11 has an alignment hook 25 that connects the display cover 11 removably to the alignment slot 24 on the holder 12. The top end 13 of the display cover has a top surface 26 upon which indicia can be displayed, such as logos, symbols, letters, numbers, pictures, words, and the like.

Figure 3:
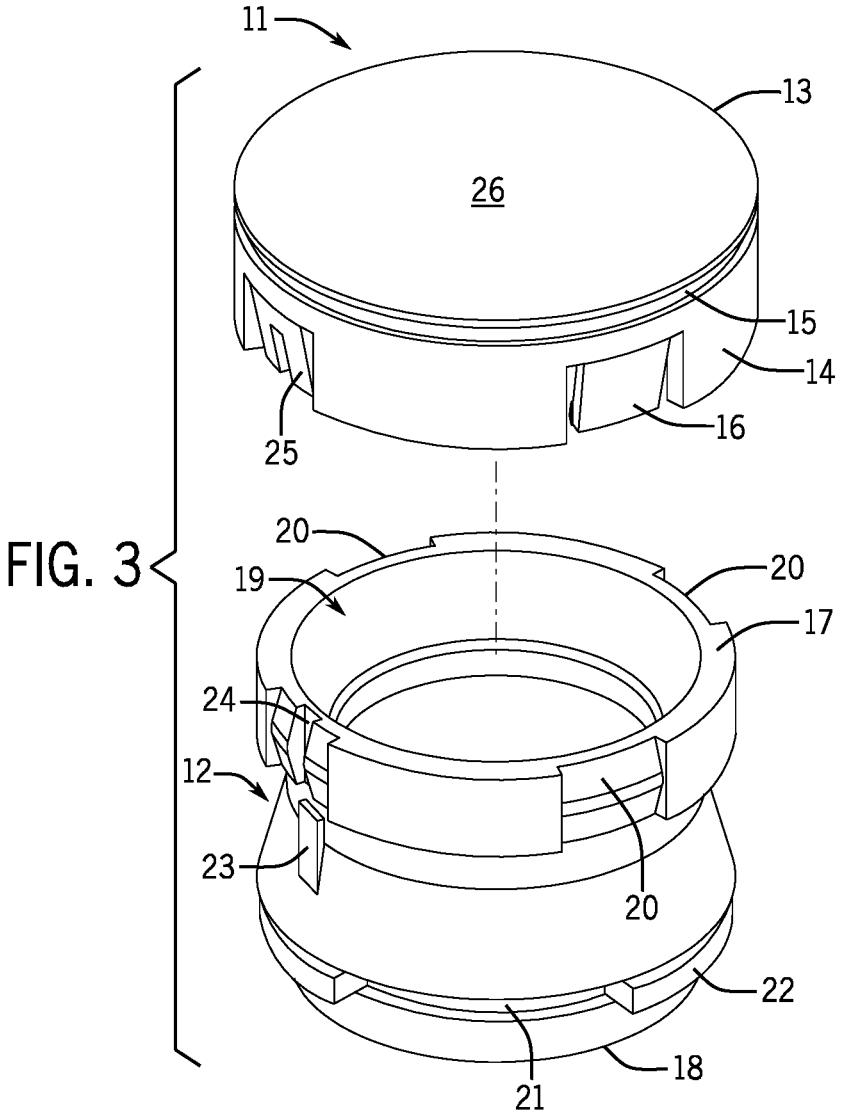
FIG. 3 shows a top perspective enlarged view of the display cover and the display cover holder.
Figure 4:
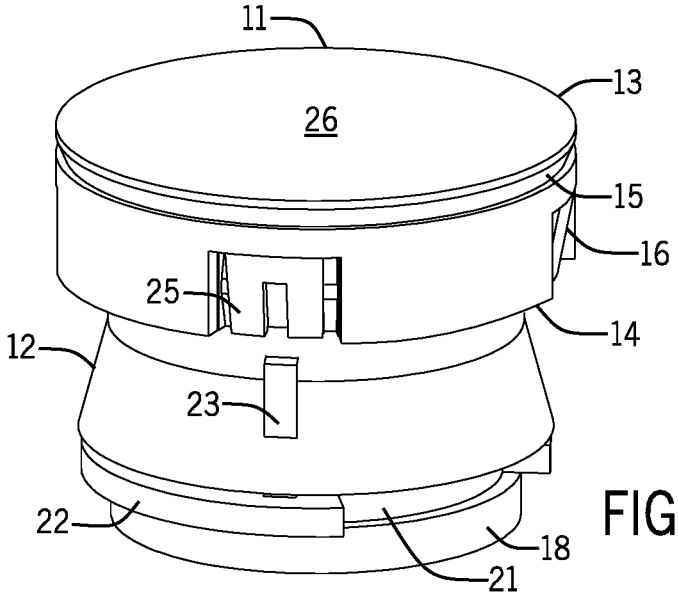
FIG. 4 shows an enlarged top perspective view of the display cover attached to the display cover holder.
Figure 5:
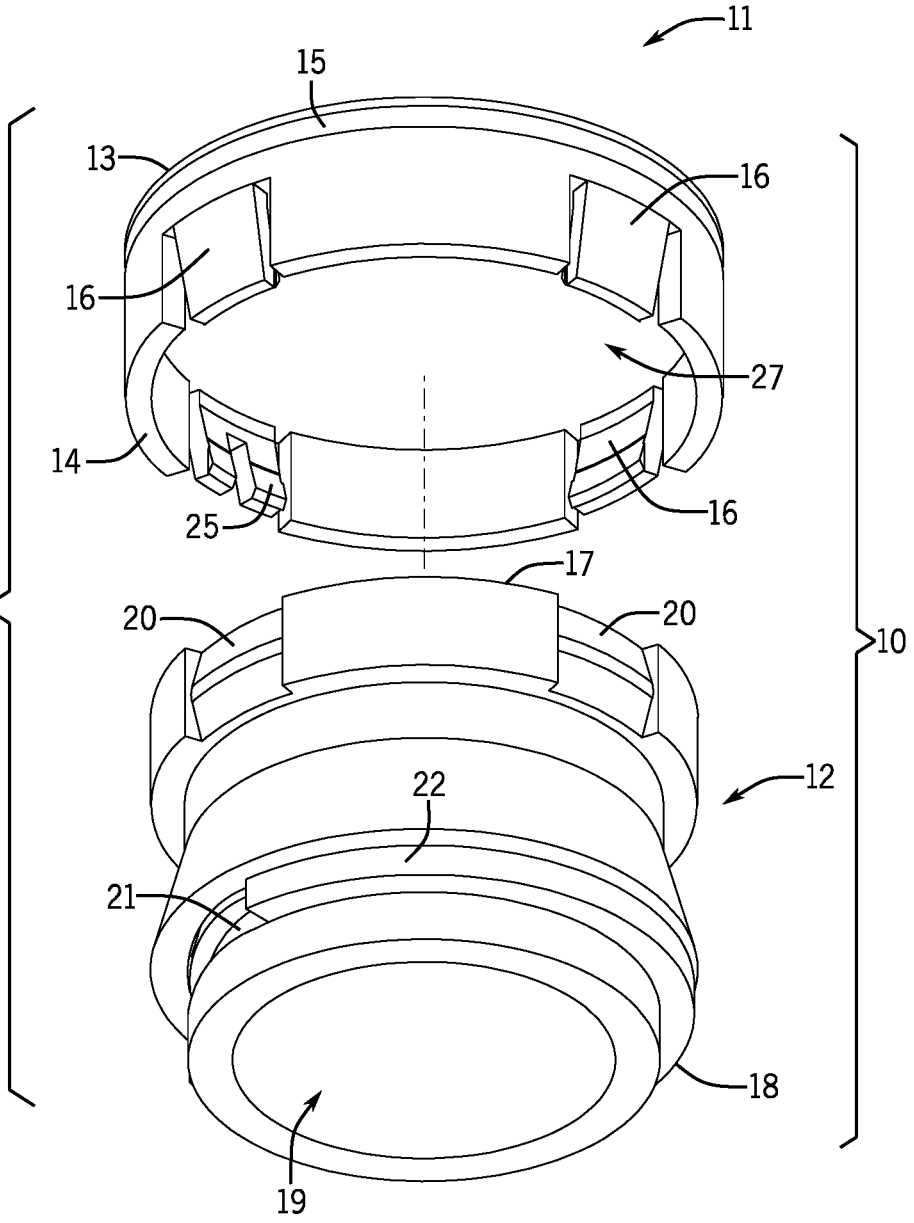
FIG. 5 shows an enlarged bottom perspective view of the display cover and the display cover holder.

FIG. 3 shows a top perspective enlarged view of the display cover 11 and a holder 12 for the display cover 11. FIG. 4 shows a top perspective enlarged view of the display cover 11 attached to the holder 12. The display cover 11 placed over a holder 12 which is paced over a push button switch can, thus, be pushed inward to operate the pushbutton switch, for example to turn the push button switch on or off or to different functions. FIG. 5 shows a bottom perspective view of the display cover 11 and the holder 12. FIG. 5 further shows the interior 27 of the display cover 11.

Figure 6:
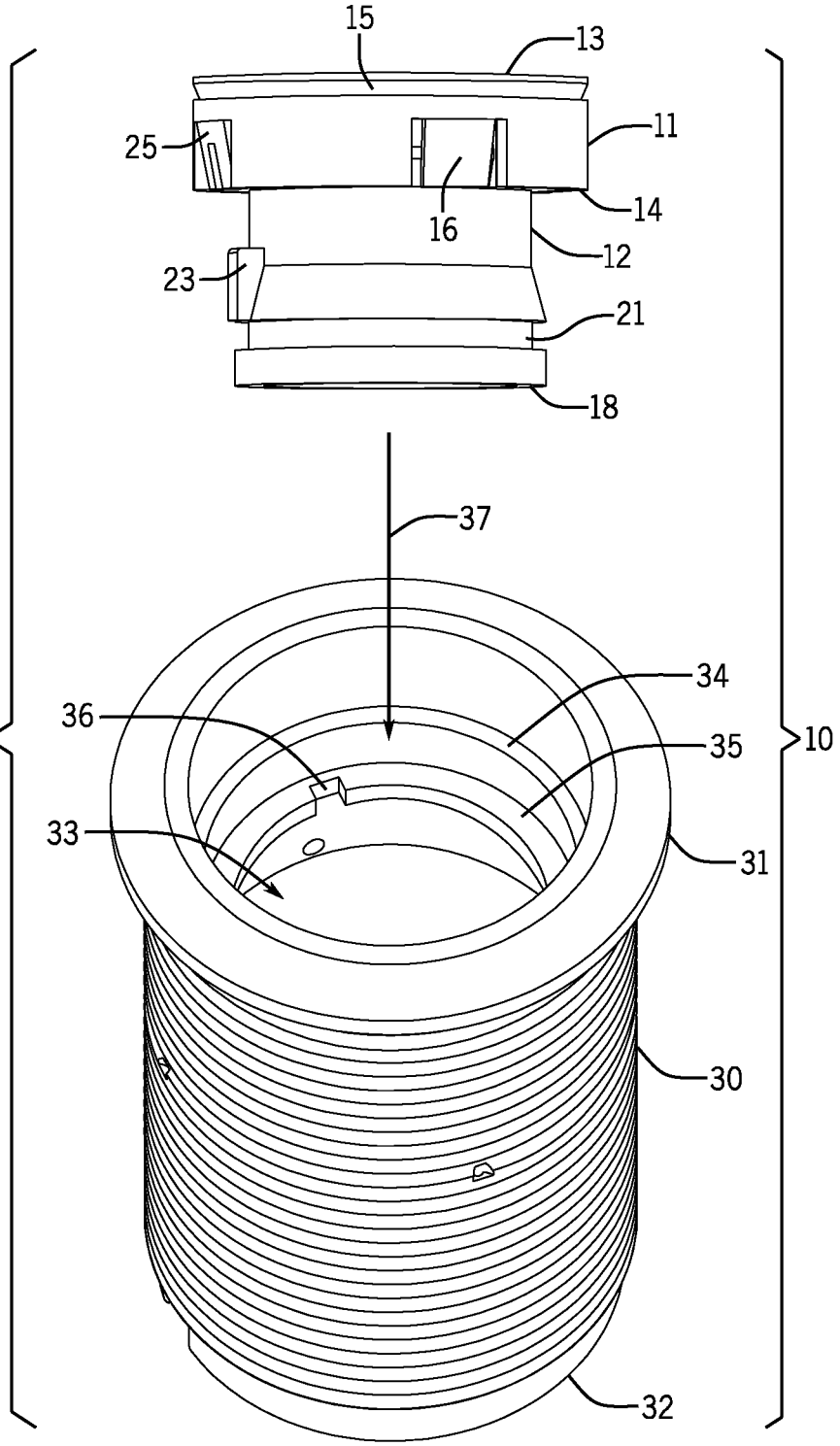
FIG. 6 shows a top perspective view of the display cover apparatus, further showing a perspective view of an interior of the housing.

FIG. 6 shows a top perspective view of the display cover apparatus 10, further showing a perspective view of the interior 33 of the housing 30. A circular shelf 34 is positioned in the interior 33. The circular shelf 34 has an interior circular flange 35 with a locking slot 36. The locking key 23 on the holder 12 fits into the locking slot 36, as indicated by the arrow 37, when the holder 12 is positioned in the housing 30.

Figure 7:
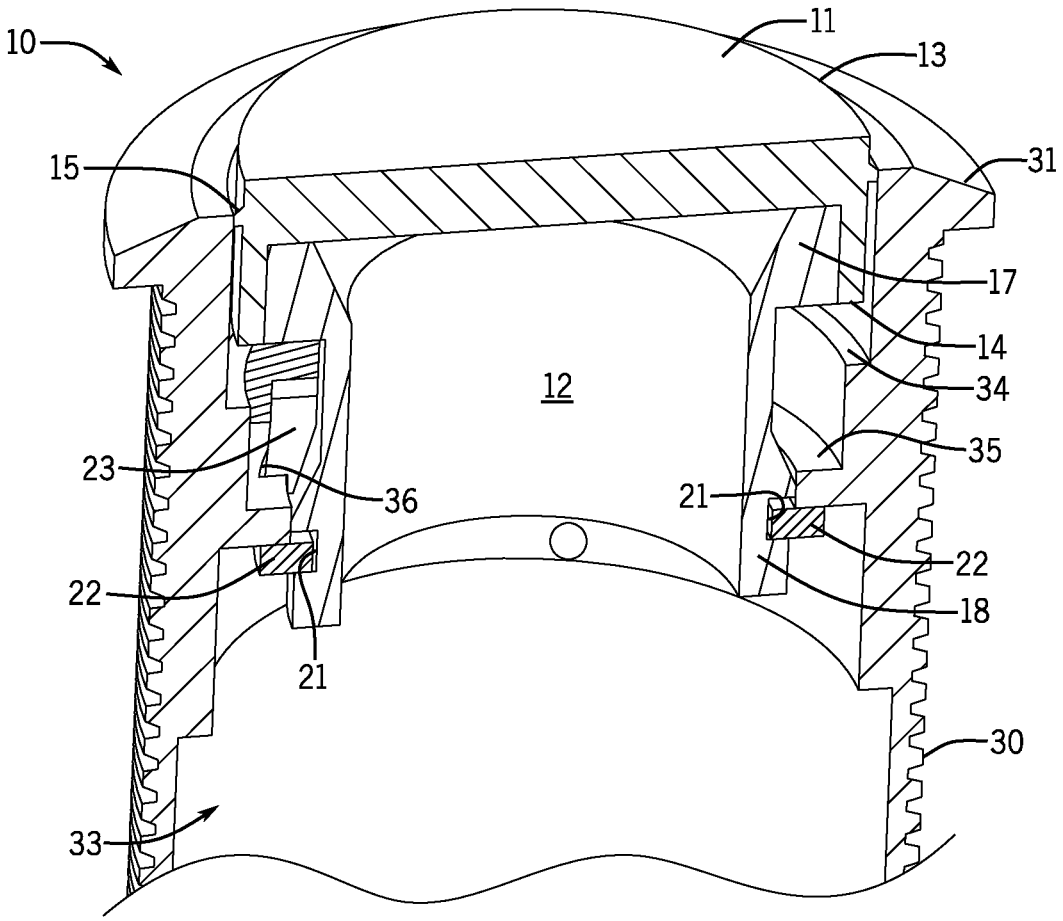
FIG. 7 shows a cutaway view of the interior of the housing with the display cover and display cover holder inserted into the interior of the housing.

FIG. 7 shows a cutaway view of the interior 33 of the housing 30 with the display cover apparatus 10 inserted into the interior 33 of the housing 30. The locking key 23 on the holder 12 is shown inserted into the locking slot 36 of the circular flange 35. The display cover 11 is removably attached to the holder 12. The flexible retaining washer 22 is extended partly out of the groove 21 at the bottom end 18 of the holder 12 and is positioned under the circular flange 35.

Figure 8:
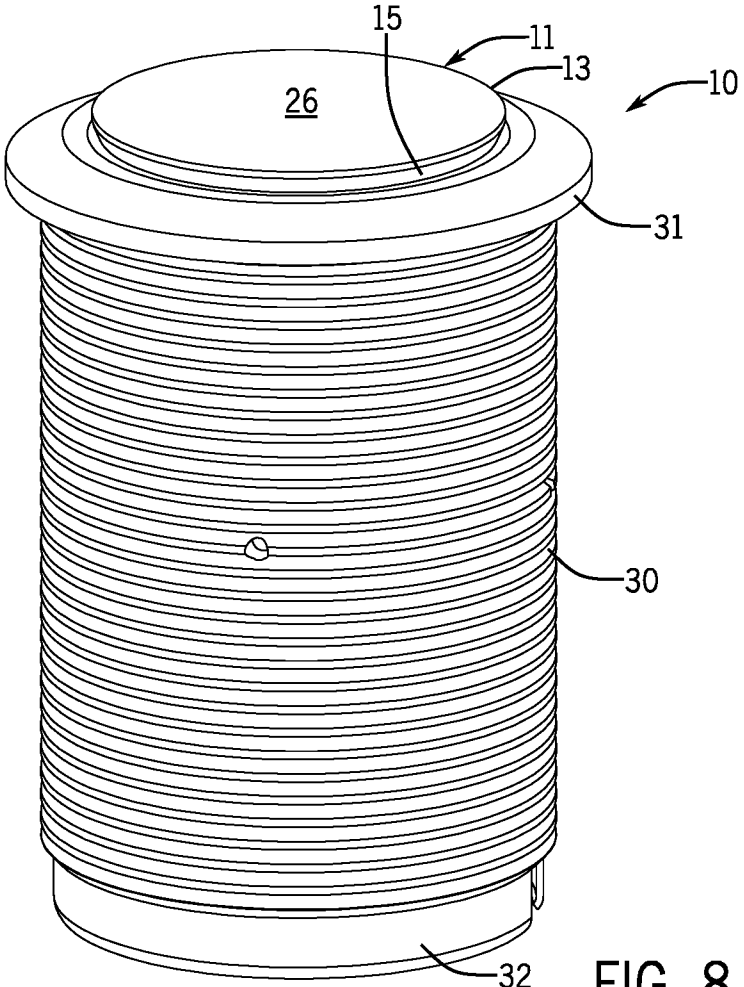
FIG. 8 shows a top, side perspective view of the housing with a display cover in place at the top end of the housing and with the display cover extending slightly above the top end of the housing.

FIG. 8 shows a top, side view of housing 30 with a display cover apparatus 10 in place at the top end 31 of the housing 30 and with the display cover 11 extending slightly above the top end 31 of the housing 30.

Figure 9:
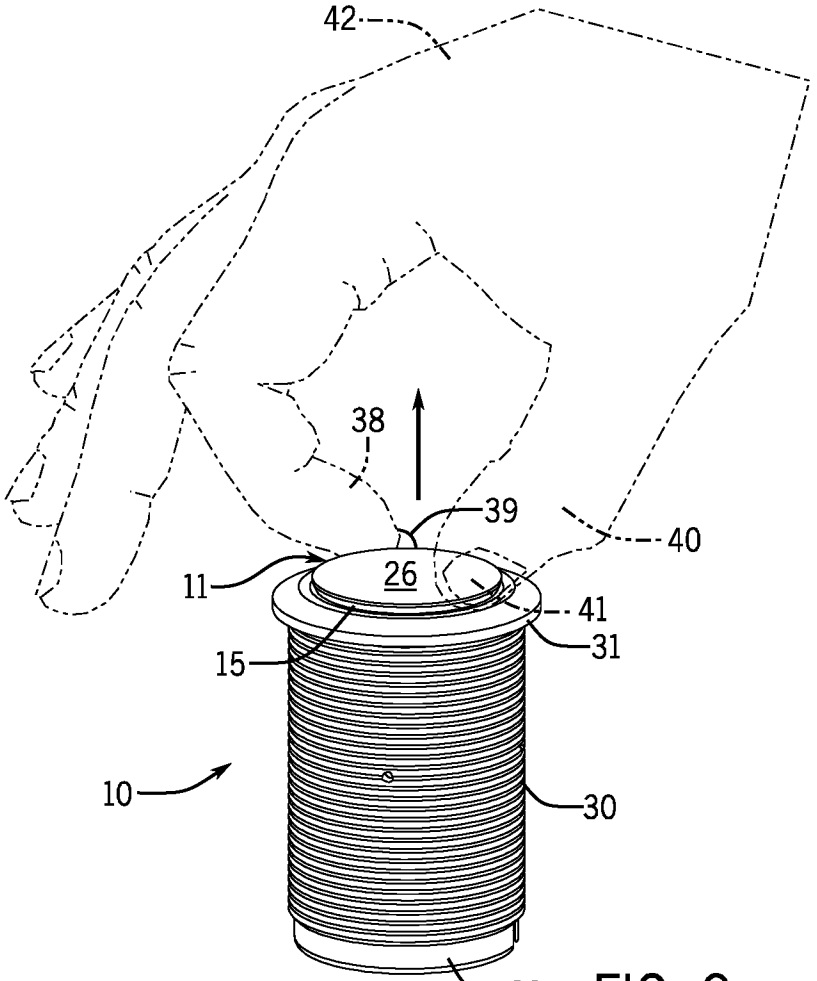
FIG. 9 shows a top perspective view of the housing with a display cover in place at the top end of the housing and with the display cover being removed from the display cover holder with the finger, thumb, and/or finger nails of a user.

FIG. 9 shows a top view of the housing 30 with the display cover 11 being removed from the holder 12 with the finger 38 and finger nail 39 and thumb 40 and thumb nail 41 of a user's hand 42. The finger 38, thumb 40, and/or nails 39, 41 grasp or are inserted into the groove 15 at the top end 13 of the display cover 11. The display cover 11 is then lifted up and off of the holder 12.

The lock hooks 16 and the lock slots 20 are constructed so that the display cover 11 will not come up off the top end 17 of the holder 12 unless pulled off with a user's fingers. The groove at the top end 13 of the display cover 11 facilitates a user's grasping the cover with the fingers or finger nails. However, the lock hook 16 and lock slot 20 arrangement does not prevent the display cover from rotating on the holder 12. Rotation of the display cover 11 is not preferred because the display should be in a fixed orientation for observing or reading. The alignment hook and the alignment slot 24 are constructed to prevent the display cover 11 from rotating on the holder 12 but do not inhibit the display cover 11 from being lifted off the holder 12. A display cover 11 with a desired display is selected by a user and snapped onto the holder 12 over the push button of a push button switch after the alignment hook and the alignment slot are placed in alignment. If it becomes desirable to put a new display over the push button switch, then the display cover 11 is lifted up off the holder 12 with the user's fingers or finger nails with sufficient force to overcome the connection force of the lock hook 16 and lock slot 20 connection. The newly selected display cover 11 is then pushed onto the holder 12 with sufficient force to create the lock hook 16 and lock slot 20 connection.

Figure 10:
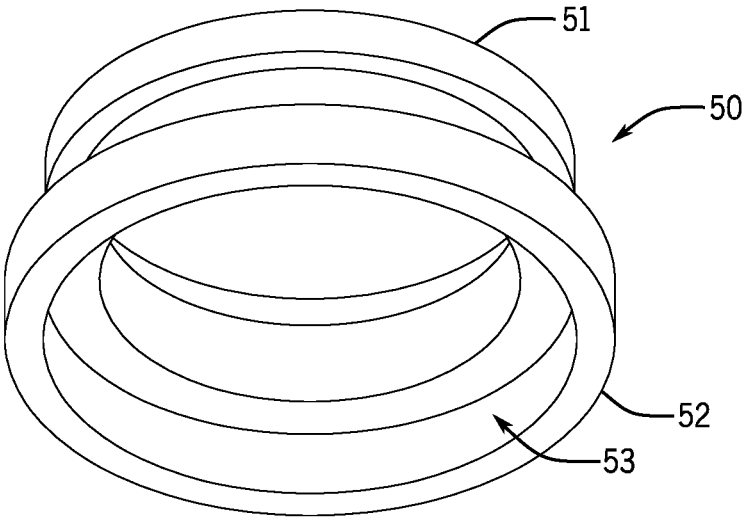
FIG. 10 shows a bottom perspective view of a cylindrical compression spring that biases the display cover holder towards the top end of the housing.
Figure 11:
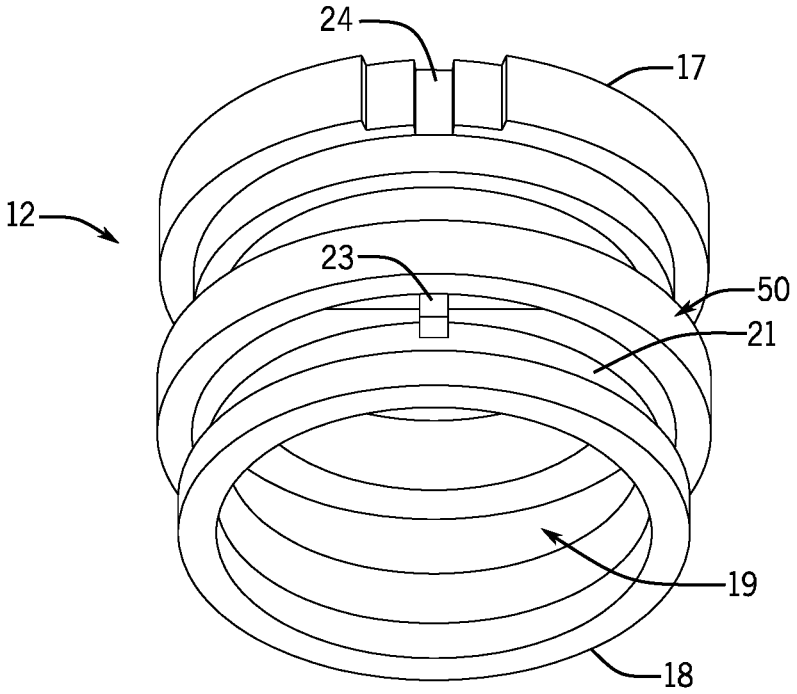
FIG. 11 shows a bottom perspective view of the cylindrical compression spring positioned on the display cover holder.

FIG. 10 shows a bottom perspective view of a cylindrical compression spring 50 that biases the display cover holder 12 towards the top end 31 of the housing 30. The spring 50 has a top end 51, a bottom end 52 and an interior 53. The spring 50 is, preferably, made of rubber or plastic, such as silicone, and is stretched over the holder 12 and positioned between the top end 17 and bottom end 18 of the holder 12. FIG. 11 shows a bottom perspective view of the cylindrical compression spring 50 positioned on the display cover holder 12.

Figure 12:
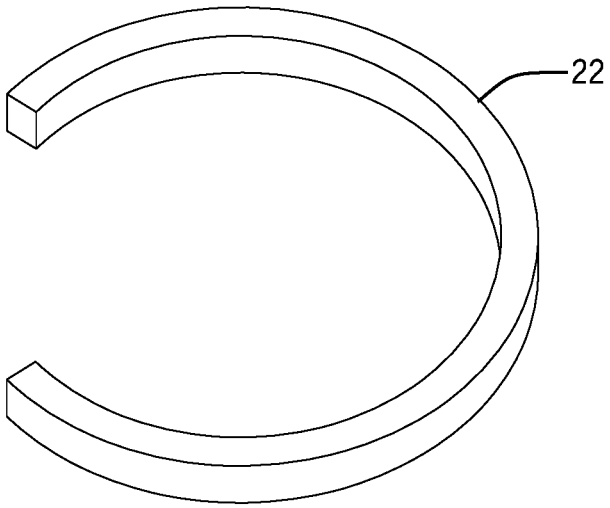
FIG. 12 shows an enlarged perspective view of a flexible retaining washer that fits on the bottom end of the display cover holder.
Figure 13:
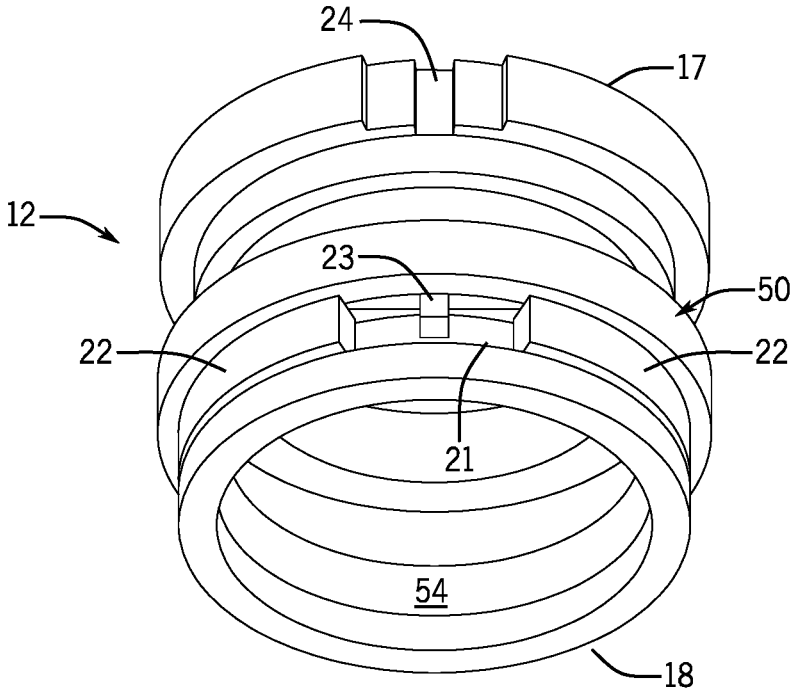
FIG. 13 shows a bottom perspective view of the cylindrical compression spring and flexible retaining washer positioned on the display cover holder

FIG. 12 shows an enlarged perspective view of a flexible retaining washer 22 that fits at the bottom end 18 of the display cover holder 12. After a holder 12 with spring 50 is inserted into the top end 31 the housing 30, the washer 22 is inserted into the bottom end 32 of the housing 30 and placed into the groove 21 at the bottom end 18 of the holder 12. The flexible retaining washer 22 is extended partly out of the groove 21 at the bottom end 18 of the holder 12 and is positioned under the circular flange 35. FIG. 13 shows a bottom perspective view of the cylindrical compression spring 50 and flexible retaining washer 22 positioned on the display cover holder 12. A cover 54 is attached to the bottom end 18 of the holder 12 so that the holder 12 will push the push button on a push button switch when the holder 12 is pushed downward towards the bottom end 32 of the housing 30.

When the holder 12 is inserted into the interior of the housing 30 it is rotated until the locking key engages the locking slot on the circular shelf in the interior of the housing 30. The holder 12 is pushed downward to push the locking key into the locking slot. When the holder 12 is pushed down for insertion of the locking key into the locking slot, the groove at the bottom end of the holder 12 is positioned below the circular flange. The flexible retaining washer is placed into the groove below the flange. In this configuration the holder 12 will not rotate in the housing and will not move up or down in the housing 30. The holder 12 is positioned in the interior of the housing 30 such that the top of the display cover 11 will extend sufficiently above the top of the housing 30 so that a user will have access to the groove at the top of the display cover 11 to remove the display cover 11 from the holder 12.

When a user pushes the display cover 11 and holder 12 downward into the housing 30 the spring becomes compressed between the flange and the top end of the holder 12. The cover on the bottom end of the holder 12 engages a push button of a push button switch to activate the switch on or off or to a different position. When the user releases the display cover 11 and holder 12 the spring pushes the display cover 11 and holder 12 back up towards the top end of the housing 30 and the cover on the bottom end 18 of the holder 12 is lifted off the push button of the push button switch.

When a user pushes the display cover and holder downward into the housing the spring becomes compressed between the flange and the top end of the holder. The cover on the bottom end of the holder engages a push button of a push button switch to activate the switch on or off or to a different position. When the user releases the display cover and holder the spring pushes the display cover and holder back up towards the top end of the housing and the cover on the bottom end of the holder is lifted off the push button of the push button switch.

The foregoing description has been limited to specific embodiments of this invention. It will be apparent, however, that variations and modifications may be made by those skilled in the art to the disclosed embodiments of the invention, with the attainment of some or all of its advantages and without departing from the spirit and scope of the present invention. For example, the lock hooks and lock slots and the alignment hook and the alignment slot may have various shapes and configurations. The display cover and the holder can be made of any suitable plastic or metal, or a combination thereof and in any suitable size or shape.

It will be understood that various changes in the details of the method and materials which have been described and illustrated above in order to explain the nature of this invention may be made by those skilled in the art without departing from the principle and scope of the invention as recited in the following claims.

I claim:

1. A display cover apparatus for a push button switch, comprising:

a) a display cover for a push button on the push button switch, a holder for the display cover, and a housing for the holder and the push button switch;

b) the display cover having a top end, a bottom end, sides, and an interior, with lock hooks on the sides near the bottom end;

c) the holder having a hollow interior, a top end with lock slots that removably connect to the lock hooks, a bottom end, a flexible retaining washer in a groove at the bottom end, and a locking key between the top end and the bottom end on an outside of the holder, wherein the lock slots are at the top end of the holder, wherein the display cover fits removably over the top end of the holder, wherein the top end of the holder is positioned removably in the interior of the display cover, and wherein the lock hooks and the lock slots are constructed so that the display cover is removable from the top end of the holder and is replaceable with other display covers;

d) the housing having a top end, a bottom end, an interior, and a circular shelf on an interior wall of the housing, the circular shelf positioned near the top end of the housing; and e) the circular shelf having an internal circular flange on an interior wall of the circular shelf, with a locking slot that receives the locking key.

2. The display cover apparatus of claim 1, further comprising an alignment hook on the display cover that removably connects to an alignment slot on the holder, thereby preventing the display cover from rotating on the holder.

3. The display cover apparatus of claim 1, wherein the lock hooks connect the display cover removably to the lock slots of the holder to prevent the display cover from falling off the holder while allowing the display cover to operate the push button.

4. The display cover apparatus of claim 1 wherein, when the holder is placed in the housing, the locking key is placed in the locking slot, thereby preventing the holder from rotating inside the housing.

5. The display cover apparatus of claim 1 wherein the display cover on the top end of the holder extends above the housing.

6. The display cover apparatus of claim 1 further comprising a circular compression spring positioned around the holder between the top end and the bottom end of the holder, wherein the compression spring biases the holder towards the top end of the housing.

7. A display cover apparatus for a push button switch, comprising:

a) a display cover for a push button on the push button switch, a holder for the display cover, and a housing for the holder and the push button switch;

b) the display cover having a top end, a bottom end, sides, and an interior, with lock hooks on the sides near the bottom end;

c) the holder having a hollow interior, a top end with lock slots that removably connect to the lock hooks, a bottom end, a flexible retaining washer in a groove at the bottom end, and a locking key between the top end and the bottom end, wherein the display cover fits removably over the top end of the holder, wherein the top end of the holder is positioned removably in the interior of the display cover, and wherein the lock hooks and the lock slots are constructed so that the display cover is removable from the top end of the holder and is replaceable with other display covers;

d) the housing having a top end, a bottom end, an interior, and a circular shelf in the interior of the housing, the circular shelf positioned near the top end of the housing; and e) the circular shelf having an internal circular flange with a locking slot that receives the locking key, wherein, when the holder is placed in the housing, the top end of the holder rests on the shelf, thereby preventing the holder from moving towards the bottom end of the housing, and the flexible retaining washer is placed under the flange, thereby preventing the holder from moving towards the top end of the housing.

8. A display cover apparatus for a push button switch, comprising:

a) a display cover for a push button on the push button switch, a holder for the display cover, and a housing for the holder and the push button switch;

b) the display cover having a top end, a bottom end, sides, and an interior, with lock hooks on the sides near the bottom end;

c) the holder having a hollow interior, a top end with lock slots that removably connect to the lock hooks, a bottom end, a flexible retaining washer in a groove at the bottom end, and a locking key between the top end and the bottom end, wherein the display cover fits removably over the top end of the holder, wherein the top end of the holder is positioned removably in the interior of the display cover, and wherein the lock hooks and the lock slots are constructed so that the display cover is removable from the top end of the holder and is replaceable with other display covers;

d) the housing having a top end, a bottom end, an interior, and a circular shelf in the interior of the housing, the circular shelf positioned near the top end of the housing; and e) the circular shelf having an internal circular flange with a locking slot that receives the locking key wherein the display cover has a groove at the top end of the display cover, the groove constructed to allow insertion of fingers or fingernails into the groove for lifting the display cover off the top end of the holder.

9. A display cover apparatus for a push button switch, comprising:

a) a display cover for a push button on the push button switch, a holder for the display cover, and a housing for the push button switch;

b) the display cover having a top end, a bottom end, sides, and an interior, with lock hooks on the sides near the bottom end;

c) the holder having a hollow interior, a top end with lock slots that removably connect to the lock hooks, a bottom end, a flexible retaining washer in a groove at the bottom end, and a locking key between the top end and the bottom end on an outside of the holder, wherein the lock slots are at the top end of the holder, wherein the display cover fits removably over the top end of the holder, wherein the top end of the holder is positioned removably in the interior of the display cover, wherein the lock hooks and the lock slots are constructed so that the display cover is removable from the top end of the holder and is replaceable with other display covers, and wherein the lock hooks connect the display cover removably to the lock slots of the holder to prevent the display cover from falling off the holder while allowing the display cover to operate the push button;

d) the housing having a top end, a bottom end, an interior, and a circular shelf on an interior of the housing, the circular shelf positioned near the top end of the housing;

e) the circular shelf having an internal circular flange on an interior wall of the circular shelf with a locking slot that receives the locking key;

f) an alignment hook on the display cover that removably connects to an alignment slot on the holder, thereby preventing the display cover from rotating on the holder; and g) a circular compression spring positioned around the holder between the top end and the bottom end of the holder, wherein the compression spring biases the holder towards the top end of the housing.

10. The display cover apparatus of claim 9 wherein, when the holder is placed in the housing, the locking key is placed in the locking slot, thereby preventing the holder from rotating inside the housing.

11. The display cover apparatus of claim 9, wherein the display cover on the top end of the holder extends above the housing.

12. A display cover apparatus for a push button switch, comprising:

a) a display cover for a push button on the push button switch, a holder for the display cover, and a housing for the push button switch;

b) the display cover having a top end, a bottom end, sides, and an interior, with lock hooks on the sides near the top end;

c) the holder having a hollow interior, a top end with lock slots that removably connect to the lock hooks, a bottom end, a flexible retaining washer in a groove at the bottom end, and a locking key between the top end and the bottom end, wherein the display cover fits removably over the top end of the holder, wherein the top end of the holder is positioned removably in the interior of the display cover, wherein the lock hooks and the lock slots are constructed so that the display cover is removable from the top end of the holder and is replaceable with other display covers, and wherein the lock hooks connect the display cover removably to the lock slots of the holder to prevent the display cover from falling off the holder while allowing the display cover to operate the push button;

d) the housing having a top end, a bottom end, an interior, and a circular shelf in the interior of the housing, the circular shelf positioned near the top end of the housing;

e) the circular shelf having an internal circular flange with a locking slot that receives the locking key;

f) an alignment hook on the display cover that removably connects to an alignment slot on the holder, thereby preventing the display cover from rotating on the holder; and g) a circular compression spring positioned around the holder between the top end and the bottom end of the holder, wherein the compression spring biases the holder towards the top end of the housing, wherein, when the holder is placed in the housing, the top end of the holder rests on the shelf, thereby preventing the holder from moving towards the bottom end of the housing, and the flexible retaining washer is placed under the flange, thereby preventing the holder from moving towards the top end of the housing.

13. A display cover apparatus for a push button switch, comprising:

a) a display cover for a push button on the push button switch, a holder for the display cover, and a housing for the push button switch;

b) the display cover having a top end, a bottom end, sides, and an interior, with lock hooks on the sides near the top end;

c) the holder having a hollow interior, a top end with lock slots that removably connect to the lock hooks, a bottom end, a flexible retaining washer in a groove at the bottom end, and a locking key between the top end and the bottom end, wherein the display cover fits removably over the top end of the holder, wherein the top end of the holder is positioned removably in the interior of the display cover, wherein the lock hooks and the lock slots are constructed so that the display cover is removable from the top end of the holder and is replaceable with other display covers, and wherein the lock hooks connect the display cover removably to the lock slots of the holder to prevent the display cover from falling off the holder while allowing the display cover to operate the push button;

d) the housing having a top end, a bottom end, an interior, and a circular shelf in the interior of the housing, the circular shelf positioned near the top end of the housing;

e) the circular shelf having an internal circular flange with a locking slot that receives the locking key;

f) an alignment hook on the display cover that removably connects to an alignment slot on the holder, thereby preventing the display cover from rotating on the holder; and g) a circular compression spring positioned around the holder between the top end and the bottom end of the holder, wherein the compression spring biases the holder towards the top end of the housing, wherein the display cover has a groove at the top end of the display cover, the groove constructed to allow insertion of fingers or fingernails into the groove for lifting the display cover off the top end of the holder.

14. A display cover apparatus for a push button switch, comprising:

a) a display cover for a push button on the push button switch, a holder for the display cover, and a housing for the push button switch;

b) the display cover having a top end, a bottom end, sides, and an interior, with lock hooks on the sides near the bottom end;

c) the holder having a hollow interior, a top end with lock slots that removably connect to the lock hooks, a bottom end, a flexible retaining washer in a groove at the bottom end, and a locking key between the top end and the bottom end on an outside of the holder, wherein the lock slots are at the top end of the holder, wherein the display cover fits removably over the top end of the holder, wherein the top end of the holder is positioned removably in the interior of the display cover, wherein the lock hooks and the lock slots are constructed so that the display cover is removable from the top end of the holder and is replaceable with other display covers, wherein the lock hooks connect the display cover removably to the lock slots of the holder to prevent the display cover from falling off the holder while allowing the display cover to operate the push button, and wherein the display cover has a groove at the top end of the display cover, the groove constructed to allow insertion of fingers or fingernails into the groove for lifting the display cover off the top end of the holder;

d) the housing having a top end, a bottom end, an interior, and a circular shelf in the on an interior wall of the housing, the circular shelf positioned near the top end of the housing;

e) the circular shelf having an internal circular flange on an interior wall of the circular shelf, with a locking slot that receives the locking key, wherein, when the holder is placed in the housing, the locking key is placed in the locking slot, thereby preventing the holder from rotating inside the housing, the top end of the holder rests on the shelf, thereby preventing the holder from moving towards the bottom end of the housing, and the flexible retaining washer is placed under the flange, thereby preventing the holder from moving towards the top end of the housing;

f) an alignment hook on the display cover that removably connects to an alignment slot on the holder, thereby preventing the display cover from rotating on the holder; and g) a circular compression spring positioned around the holder between the top end and the bottom end of the holder, wherein the compression spring biases the holder towards the top end of the housing.

15. A display cover apparatus for a push button switch, comprising:

a) a display cover for a push button on the push button switch, a holder for the display cover, and a housing for the push button switch;

b) the display cover having a top end, a bottom end, sides, and an interior, with lock hooks on the sides near the top end;

c) the holder having a hollow interior, a top end with lock slots that removably connect to the lock hooks, a bottom end, a flexible retaining washer in a groove at the bottom end, and a locking key between the top end and the bottom end, wherein the display cover fits removably over the top end of the holder, wherein the top end of the holder is positioned removably in the interior of the display cover, wherein the lock hooks and the lock slots are constructed so that the display cover is removable from the top end of the holder and is replaceable with other display covers, wherein the lock hooks connect the display cover removably to the lock slots of the holder to prevent the display cover from falling off the holder while allowing the display cover to operate the push button, and wherein the display cover has a groove at the top end of the display cover, the groove constructed to allow insertion of fingers or fingernails into the groove for lifting the display cover off the top end of the holder;

d) the housing having a top end, a bottom end, an interior, and a circular shelf in the interior of the housing, the circular shelf positioned near the top end of the housing;

e) the circular shelf having an internal circular flange with a locking slot that receives the locking key, wherein, when the holder is placed in the housing, the locking key is placed in the locking slot, thereby preventing the holder from rotating inside the housing, the top end of the holder rests on the shelf, thereby preventing the holder from moving towards the bottom end of the housing, and the flexible retaining washer is placed under the flange, thereby preventing the holder from moving towards the top end of the housing;

f) an alignment hook on the display cover that removably connects to an alignment slot on the holder, thereby preventing the display cover from rotating on the holder; and g) a circular compression spring positioned around the holder between the top end and the bottom end of the holder, wherein the compression spring biases the holder towards the top end of the housing, wherein, the display cover on the top end of the holder extends above the housing.

* * * * *